US007895860B2

(12) United States Patent
Tucker et al.

(10) Patent No.: US 7,895,860 B2
(45) Date of Patent: Mar. 1, 2011

(54) MULTICHANNEL EVAPORATOR WITH FLOW MIXING MANIFOLD

(75) Inventors: Jeffrey Lee Tucker, Wichita, KS (US); Mahesh Valiya-Naduvath, Lutherville, MD (US); John T. Knight, Wichita, KS (US); Judd M. Vance, Wichita, KS (US)

(73) Assignee: Johnson Controls Technology Company, Holland, MI (US)

( * ) Notice: Subject to any disclaimer, the term of this patent is extended or adjusted under 35 U.S.C. 154(b) by 381 days.

(21) Appl. No.: 12/040,501

(22) Filed: Feb. 29, 2008

(65) Prior Publication Data

US 2008/0141706 A1 Jun. 19, 2008

Related U.S. Application Data

(63) Continuation of application No. PCT/US2007/085231, filed on Nov. 20, 2007.

(60) Provisional application No. 60/882,033, filed on Dec. 27, 2006, provisional application No. 60/867,043, filed on Nov. 22, 2006.

(51) Int. Cl.
*F25B 41/00* (2006.01)

(52) U.S. Cl. ..... 62/513; 62/515

(58) Field of Classification Search ..... 62/513, 62/515, 519, 498; 165/173, 174
See application file for complete search history.

(56) References Cited

U.S. PATENT DOCUMENTS

| | | | | |
|---|---|---|---|---|
| 3,229,722 | A | | 1/1966 | Kritzer |
| 3,603,384 | A | | 9/1971 | Huggins et al. |
| 3,636,982 | A | | 1/1972 | Drake |
| 3,871,407 | A | | 3/1975 | Bykov et al. |
| 4,031,602 | A | | 6/1977 | Cunningham et al. |
| 4,190,105 | A | | 2/1980 | Dankowski |
| 4,362,612 | A | * | 12/1982 | Bier ..... 204/627 |
| 4,370,868 | A | | 2/1983 | Kim |
| 4,674,888 | A | * | 6/1987 | Carlson ..... 366/337 |
| 4,766,953 | A | | 8/1988 | Grieb et al. |
| 4,971,145 | A | | 11/1990 | Lyon |
| 5,127,154 | A | | 7/1992 | Johnson et al. |
| 5,168,925 | A | | 12/1992 | Suzumura |
| 5,186,248 | A | | 2/1993 | Halstead |
| 5,186,249 | A | | 2/1993 | Bhatti et al. |
| 5,251,692 | A | | 10/1993 | Haussmann |
| 5,327,959 | A | | 7/1994 | Saperstein |
| 5,339,654 | A | * | 8/1994 | Cook et al. ..... 62/476 |
| 5,372,188 | A | | 12/1994 | Dudley |

(Continued)

FOREIGN PATENT DOCUMENTS

DE 19719251 11/1998

(Continued)

OTHER PUBLICATIONS

U.S. Appl. No. 12/040,559, filed Feb. 29, 2008, Knight et al.

(Continued)

*Primary Examiner* — Melvin Jones
(74) *Attorney, Agent, or Firm* — Fletcher Yoder

(57) ABSTRACT

Heating, ventilation, air conditioning, and refrigeration (HVAC&R) systems and heat exchangers are provided which include manifold configurations designed to promote mixing of vapor phase and liquid phase refrigerant. The manifolds contain flow mixers such as a helical tape, sectioned volumes, and partitions containing apertures. The flow mixers direct the flow of refrigerant within the manifold to promote a more homogenous distribution of fluid within the multichannel tubes.

21 Claims, 7 Drawing Sheets

U.S. PATENT DOCUMENTS

| | | | | |
|---|---|---|---|---|
| 5,398,515 | A * | 3/1995 | Lak | 62/47.1 |
| 5,448,899 | A | 9/1995 | Ohara | |
| 5,479,784 | A | 1/1996 | Dobmeier | |
| 5,546,925 | A * | 8/1996 | Knight et al. | 126/110 R |
| 5,586,598 | A | 12/1996 | Tanaka et al. | |
| 5,797,184 | A | 8/1998 | Tanaka et al. | |
| 5,826,646 | A | 10/1998 | Bae | |
| 5,836,382 | A | 11/1998 | Dingle | |
| 5,901,782 | A | 5/1999 | Voss | |
| 5,901,785 | A | 5/1999 | Chiba | |
| 5,910,167 | A | 6/1999 | Reinke | |
| 5,934,367 | A | 8/1999 | Shimmura | |
| 5,941,303 | A | 8/1999 | Gowan et al. | |
| 5,967,228 | A | 10/1999 | Bergman | |
| 6,017,022 | A * | 1/2000 | Shirtum | 261/75 |
| 6,047,797 | A * | 4/2000 | Popjoy | 188/269 |
| 6,116,335 | A | 9/2000 | Beamer | |
| 6,148,635 | A | 11/2000 | Beebe | |
| 6,155,075 | A | 12/2000 | Hanson | |
| 6,179,051 | B1 | 1/2001 | Ayub | |
| 6,199,401 | B1 | 3/2001 | Haussmann | |
| 6,237,677 | B1 | 5/2001 | Kent et al. | |
| 6,401,473 | B1 * | 6/2002 | Ng et al. | 62/239 |
| 6,449,979 | B1 | 9/2002 | Nagasawa | |
| 6,453,681 | B1 * | 9/2002 | Lak et al. | 62/50.1 |
| 6,502,413 | B2 | 1/2003 | Repice | |
| 6,688,137 | B1 | 2/2004 | Gupte | |
| 6,814,136 | B2 | 11/2004 | Yi | |
| 6,827,128 | B2 | 12/2004 | Philpott | |
| 6,868,696 | B2 | 3/2005 | Ikuta | |
| 6,886,349 | B1 | 5/2005 | Curicuta | |
| 6,892,802 | B2 | 5/2005 | Kelly | |
| 6,904,770 | B2 | 6/2005 | Telesz et al. | |
| 6,904,966 | B2 | 6/2005 | Philpott | |
| 6,912,864 | B2 | 7/2005 | Roche | |
| 6,932,153 | B2 | 8/2005 | Ko | |
| 6,964,296 | B2 | 11/2005 | Memory | |
| 6,988,538 | B2 | 1/2006 | Merkys | |
| 7,000,415 | B2 | 2/2006 | Daddis | |
| 7,003,971 | B2 | 2/2006 | Kester | |
| 7,021,370 | B2 | 4/2006 | Papapanu | |
| 7,028,483 | B2 | 4/2006 | Mansour | |
| 7,044,200 | B2 | 5/2006 | Gupte | |
| 7,066,243 | B2 | 6/2006 | Horiuchi | |
| 7,080,526 | B2 | 7/2006 | Papapanu | |
| 7,107,787 | B2 | 9/2006 | Inaba | |
| 7,143,605 | B2 | 12/2006 | Rohrer | |
| 7,152,669 | B2 | 12/2006 | Kroetsch et al. | |
| 7,163,052 | B2 | 1/2007 | Taras | |
| 7,201,015 | B2 | 4/2007 | Feldman | |
| 7,219,511 | B2 | 5/2007 | Inaba | |
| 7,222,501 | B2 | 5/2007 | Cho | |
| 2003/0192677 | A1 | 10/2003 | Rong | |
| 2004/0134226 | A1 | 7/2004 | Kraay | |
| 2004/0261983 | A1 | 12/2004 | Hu | |
| 2005/0056049 | A1 | 3/2005 | Sanada | |
| 2005/0217831 | A1 | 10/2005 | Manaka | |
| 2005/0241816 | A1 | 11/2005 | Shabtay et al. | |
| 2005/0269069 | A1 | 12/2005 | Hancock | |
| 2006/0102331 | A1 | 5/2006 | Taras et al. | |
| 2006/0102332 | A1 | 5/2006 | Taras | |
| 2006/0130517 | A1 | 6/2006 | Merkys | |
| 2007/0039724 | A1 | 2/2007 | Trumbower | |
| 2008/0023183 | A1 | 1/2008 | Beamer et al. | |
| 2008/0023184 | A1 | 1/2008 | Beamer et al. | |
| 2008/0023185 | A1 | 1/2008 | Beamer et al. | |
| 2008/0023186 | A1 | 1/2008 | Beamer et al. | |
| 2008/0060199 | A1 | 3/2008 | Fuller et al. | |
| 2008/0078541 | A1 | 4/2008 | Beamer et al. | |
| 2008/0092587 | A1 | 4/2008 | Gorbounov et al. | |
| 2008/0093051 | A1 | 4/2008 | Rios et al. | |
| 2008/0093062 | A1 | 4/2008 | Gorbounov et al. | |

FOREIGN PATENT DOCUMENTS

| | | |
|---|---|---|
| DE | 19740114 | 3/1999 |
| DE | 2006018681 | 10/2006 |
| EP | 0219974 | 4/1987 |
| EP | 0583851 | 2/1994 |
| GB | 2250336 | 6/1992 |
| JP | 56130595 | 10/1981 |
| JP | 58045495 | 3/1983 |
| JP | 04069228 | 3/1992 |
| JP | 04186070 | 6/1992 |
| JP | 07190661 | 7/1995 |
| JP | 10062092 | 3/1998 |
| JP | 11083371 | 3/1999 |
| WO | WO02/103270 | 12/2002 |
| WO | WO 02103263 | 12/2002 |
| WO | WO2006/083426 | 8/2006 |
| WO | WO2006/083435 | 8/2006 |
| WO | WO2006/083441 | 8/2006 |
| WO | WO2006/083442 | 8/2006 |
| WO | WO2006/083443 | 8/2006 |
| WO | WO2006/083445 | 8/2006 |
| WO | WO2006/083446 | 8/2006 |
| WO | WO2006/083447 | 8/2006 |
| WO | WO2006/083448 | 8/2006 |
| WO | WO2006/083449 | 8/2006 |
| WO | WO2006/083450 | 8/2006 |
| WO | WO2006/083451 | 8/2006 |
| WO | WO2006/083484 | 8/2006 |
| WO | WO 2006083445 | 8/2006 |

OTHER PUBLICATIONS

U.S. Appl. No. 12/040,588, filed Feb. 29, 2008, Valiya-Naduvath et al.
U.S. Appl. No. 12/040,612, filed Feb. 29, 2008, Yanik et al.
U.S. Appl. No. 12/040,661, filed Feb. 29, 2008, Yanik et al.
U.S. Appl. No. 12/040,697, filed Feb. 29, 2008, Yanik et al.
U.S. Appl. No. 12/040,724, filed Feb. 29, 2008, Obosu et al.
U.S. Appl. No. 12/040,743, filed Feb. 29, 2008, Breiding et al.
U.S. Appl. No. 12/040,764, filed Feb. 29, 2008, Knight.

* cited by examiner

FIG. 1
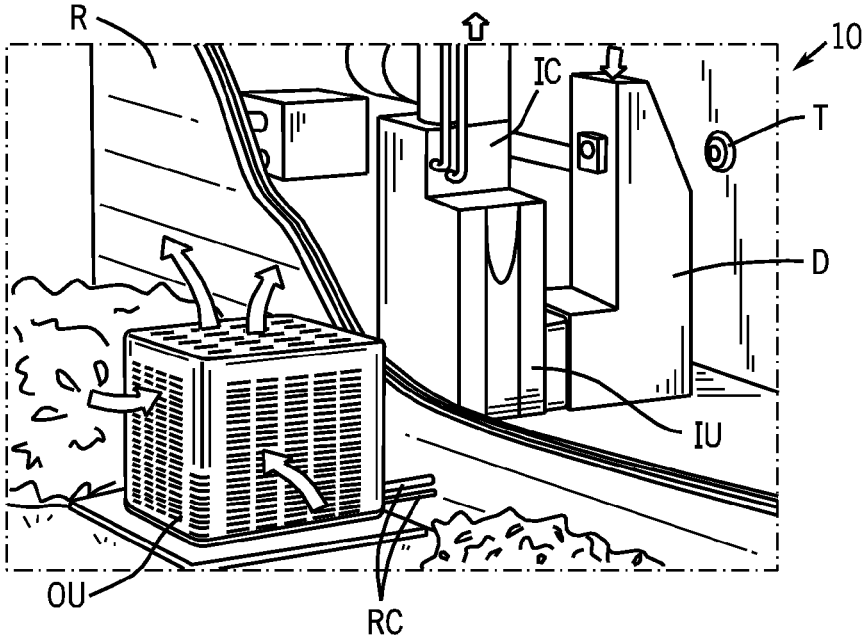
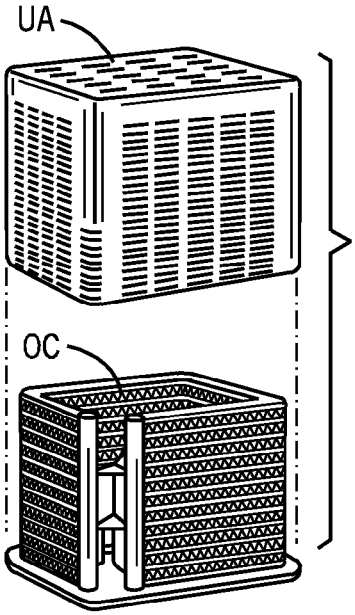
FIG. 2
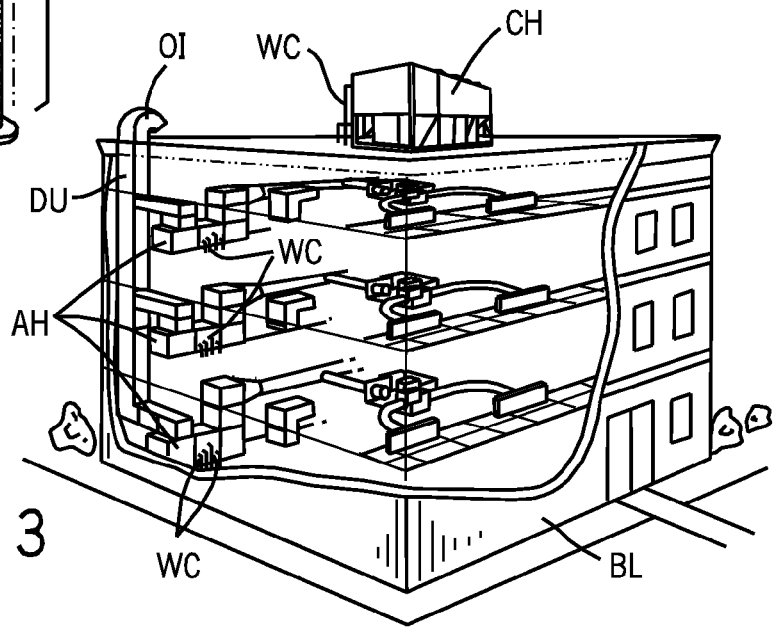
FIG. 3

FIG. 6
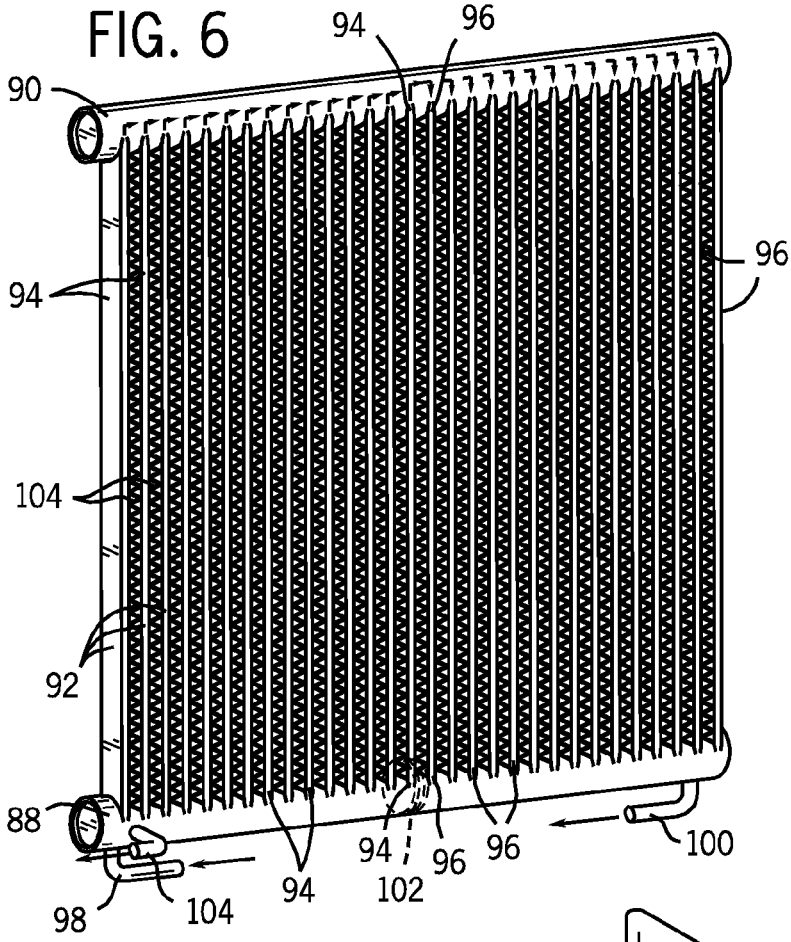
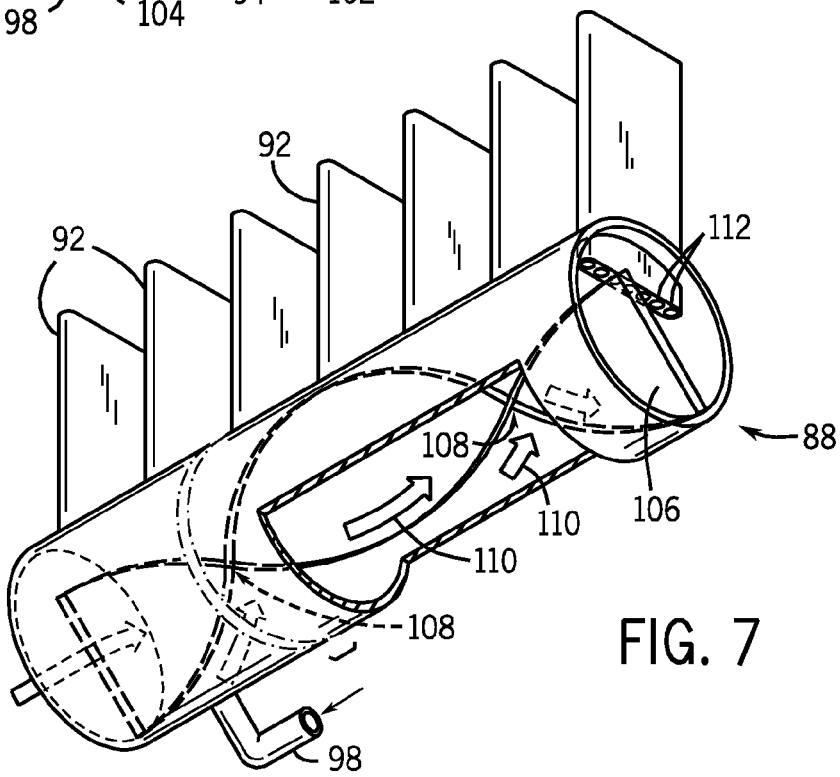
FIG. 7

MULTICHANNEL EVAPORATOR WITH FLOW MIXING MANIFOLD

CROSS REFERENCE TO RELATED APPLICATIONS

This application claims priority from and the benefit of U.S. Provisional Application Ser. No. 60/867,043, entitled MICROCHANNEL HEAT EXCHANGER APPLICATIONS, filed Nov. 22, 2006, and U.S. Provisional Application Ser. No. 60/882,033, entitled MICROCHANNEL HEAT EXCHANGER APPLICATIONS, filed Dec. 27, 2006, which are hereby incorporated by reference.

BACKGROUND

The invention relates generally to multichannel evaporators with flow mixing manifolds.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels. Fins may be positioned between the tubes to facilitate heat transfer between refrigerant contained within the tube flow channels and external air passing over the tubes. Multichannel heat exchangers may be used in small tonnage systems, such as residential systems, or in large tonnage systems, such as industrial chiller systems.

In general, heat exchangers transfer heat by circulating a refrigerant through a cycle of evaporation and condensation. In many systems, the refrigerant changes phases while flowing through heat exchangers in which evaporation and condensation occur. For example, the refrigerant may enter an evaporator heat exchanger as a liquid and exit as a vapor. In another example, the refrigerant may enter a condenser heat exchanger as a vapor and exit as a liquid. Generally, a portion of the heat transfer is achieved from the phase change that occurs within the heat exchangers. That is, while some energy is transferred to and from the refrigerant by changes in the temperature of the fluid (i.e., sensible heat), more energy is exchanged by phase changes (i.e., latent heat). For example, in the case of an evaporator, the external air is cooled when the liquid refrigerant flowing through the heat exchanger absorbs heat from the air causing the liquid refrigerant to change to a vapor. Therefore, it is generally preferred for the refrigerant entering an evaporator to contain as much liquid as possible to maximize the heat transfer. If the refrigerant enters an evaporator as a vapor, heat absorbed by the refrigerant may be sensible heat only, reducing the overall heat absorption of the unit that would otherwise be available if a phase change were to take place.

In general, an expansion device is located in a closed loop prior to the evaporator. The expansion device lowers the temperature and pressure of the refrigerant by increasing its volume. However, during the expansion process, some of the liquid refrigerant may be expanded to form vapor. Therefore, a mixture of liquid and vapor refrigerant typically enters the evaporator. Because the vapor refrigerant has a lower density than the liquid refrigerant, the vapor refrigerant tends to separate from the liquid refrigerant resulting in some multichannels receiving mostly vapor. The tubes containing primarily vapor are not able to absorb much heat, which may result in inefficient heat transfer.

SUMMARY

In accordance with aspects of the invention, a heat exchanger is presented. The heat exchanger includes a first manifold, a second manifold, a plurality of multichannel tubes in fluid communication with the manifolds, and a flow mixer included in the first manifold to promote mixing of liquid and vapor phases within the multichannel tubes.

In accordance with further aspects of the invention, a heat exchanger and a system including a heat exchanger are presented. The heat exchanger includes a first manifold configured to receive a mixed phase flow of liquid and vapor, a second manifold, and a plurality of multichannel tubes in fluid communication with the manifolds. The first manifold is configured to promote mixing of the liquid and vapor to direct mixed phase flow through the multichannel tubes.

DRAWINGS

FIG. 1 is a perspective view of an exemplary residential air conditioning or heat pump system of the type that might employ a heat exchanger.

FIG. 2 is a partially exploded view of the outside unit of the system of FIG. 1, with an upper assembly lifted to expose certain of the system components, including a heat exchanger.

FIG. 3 is a perspective view of an exemplary commercial or industrial HVAC&R system that employs a chiller and air handlers to cool a building and that may employ heat exchangers.

FIG. 6 is a perspective view of an exemplary heat exchanger containing manifold configurations.

FIG. 7 is a detail perspective view of an exemplary manifold containing a helical tape.

DETAILED DESCRIPTION

Figure 4:
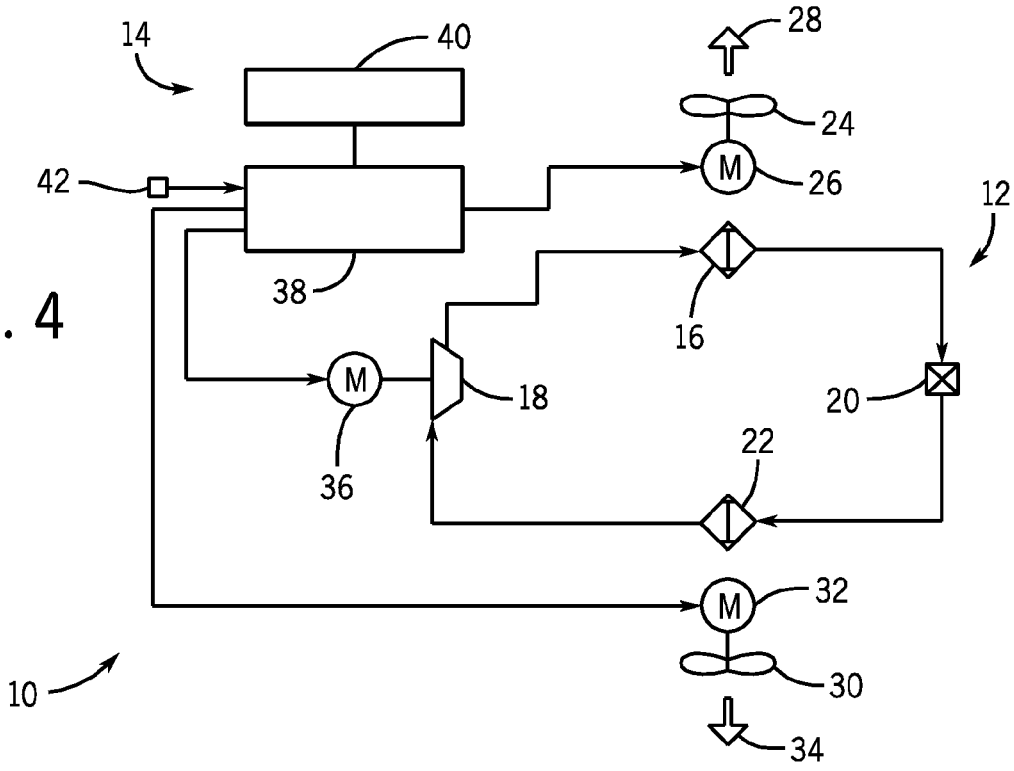
FIG. 4 is a diagrammatical overview of an exemplary air conditioning system, which may employ one or more heat exchangers with manifold configurations.

FIGS. 1-3 depict exemplary applications for heat exchangers. Such systems, in general, may be applied in a range of settings, both within the HVAC&R field and outside of that field. In presently contemplated applications, however, heat exchangers may be used in residential, commercial, light industrial, industrial and in any other application for heating or cooling a volume or enclosure, such as a residence, building, structure, and so forth. Moreover, the heat exchangers may be used in industrial applications, where appropriate, for basic refrigeration and heating of various fluids. FIG. 1 illustrates a residential heating and cooling system. In general, a residence, designated by the letter R, will be equipped with an outdoor unit OU that is operatively coupled to an indoor unit IU. The outdoor unit is typically situated adjacent to a side of the residence and is covered by a shroud to protect the system components and to prevent leaves and other contaminants from entering the unit. The indoor unit may be positioned in a utility room, an attic, a basement, and so forth. The outdoor unit is coupled to the indoor unit by refrigerant conduits RC that transfer primarily liquid refrigerant in one direction and primarily vaporized refrigerant in an opposite direction.

When the system shown in FIG. 1 is operating as an air conditioner, a coil in the outdoor unit serves as a condenser for recondensing vaporized refrigerant flowing from indoor unit IU to outdoor unit OU via one of the refrigerant conduits. In these applications, a coil of the indoor unit, designated by the reference characters IC, serves as an evaporator coil. The evaporator coil receives liquid refrigerant (which may be expanded by an expansion device described below) and evaporates the refrigerant before returning it to the outdoor unit.

The outdoor unit draws in environmental air through sides as indicated by the arrows directed to the sides of unit OU, forces the air through the outer unit coil by a means of a fan (not shown) and expels the air as indicated by the arrows above the outdoor unit. When operating as an air conditioner, the air is heated by the condenser coil within the outdoor unit and exits the top of the unit at a temperature higher than it entered the sides. Air is blown over indoor coil IC, and is then circulated through the residence by means of ductwork D, as indicated by the arrows in FIG. 1. The overall system operates to maintain a desired temperature as set by a thermostat T. When the temperature sensed inside the residence is higher than the set point on the thermostat (plus a small amount) the air conditioner will become operative to refrigerate additional air for circulation through the residence. When the temperature reaches the set point (minus a small amount) the unit will stop the refrigeration cycle temporarily.

When the unit in FIG. 1 operates as a heat pump, the roles of the coils are simply reversed. That is, the coil of the outdoor unit will serve as an evaporator to evaporate refrigerant and thereby cool air entering the outdoor unit as the air passes over the outdoor unit coil. Indoor coil IC will receive a stream of air blown over it and will heat the air by condensing a refrigerant.

FIG. 2 illustrates a partially exploded view of one of the units shown in FIG. 1, in this case outdoor unit OU. In general, the unit may be thought of as including an upper assembly UA made up of a shroud, a fan assembly, a fan drive motor, and so forth. In the illustration of FIG. 2, the fan and fan drive motor are not visible because they are hidden by the surrounding shroud. An outdoor coil OC is housed within this shroud and is generally deposed to surround or at least partially surround other system components, such as a compressor, an expansion device, a control circuit.

FIG. 3 illustrates another exemplary application, in this case an HVAC&R system for building environmental management. A building BL is cooled by a system that includes a chiller CH, which is typically disposed on or near the building, or in an equipment room or basement. Chiller CH is an air-cooled device that implements a refrigeration cycle to cool water. The water is circulated to a building through water conduits WC. The water conduits are routed to air handlers AH at individual floors or sections of the building. The air handlers are also coupled to ductwork DU that is adapted to blow air from an outside intake OI.

Chiller CH, which includes heat exchangers for both evaporating and condensing a refrigerant as described above, cools water that is circulated to the air handlers. Air blown over additional coils that receive the water in the air handlers causes the water to increase in temperature and the circulated air to decrease in temperature. The cooled air is then routed to various locations in the building via additional ductwork. Ultimately, distribution of the air is routed to diffusers that deliver the cooled air to offices, apartments, hallways, and any other interior spaces within the building. In many applications, thermostats or other command devices (not shown in FIG. 3) will serve to control the flow of air through and from the individual air handlers and ductwork to maintain desired temperatures at various locations in the structure.

FIG. 4 illustrates an air conditioning system 10, which uses multichannel tubes. Refrigerant flows through the system within closed refrigeration loop 12. The refrigerant may be any fluid that absorbs and extracts heat. For example, the refrigerant may be hydrofluorocarbon (HFC) based R-410A, R-407, or R-134a, or it may be carbon dioxide (R-744) or ammonia (R-717). Air conditioning system 10 includes control devices 14 that enable system 10 to cool an environment to a prescribed temperature.

System 10 cools an environment by cycling refrigerant within closed refrigeration loop 12 through condenser 16, compressor 18, expansion device 20, and evaporator 22. The refrigerant enters condenser 16 as a high pressure and temperature vapor and flows through the multichannel tubes of condenser 16. A fan 24, which is driven by a motor 26, draws air across the multichannel tubes. Fan 24 may push or pull air across the tubes. Heat transfers from the refrigerant vapor to the air producing heated air 28 and causing the refrigerant vapor to condense into a liquid. The liquid refrigerant then flows into an expansion device 20 where the refrigerant expands to become a low pressure and temperature liquid. Typically, expansion device 20 will be a thermal expansion valve (TXV); however, in other embodiments, the expansion device may be an orifice or a capillary tube. After the refrigerant exits the expansion device, some vapor refrigerant may be present in addition to the liquid refrigerant.

From expansion device 20, the refrigerant enters evaporator 22 and flows through the evaporator multichannel tubes. A fan 30, which is driven by a motor 32, draws air across the multichannel tubes. Heat transfers from the air to the refrigerant liquid producing cooled air 34 and causing the refrigerant liquid to boil into a vapor. In some embodiments, the fan may be replaced by a pump that draws fluid across the multichannel tubes.

The refrigerant then flows to compressor 18 as a low pressure and temperature vapor. Compressor 18 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 18 is driven by a motor 36 that receives power from a variable speed drive (VSD) or a direct AC or DC power source. In one embodiment, motor 36 receives fixed line voltage and frequency from an AC power source although in some applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 18 as a high temperature and pressure vapor that is ready to enter the condenser and begin the refrigeration cycle again.

The operation of the refrigeration cycle is governed by control devices 14 which include control circuitry 38, an input device 40, and a temperature sensor 42. Control circuitry 38 is coupled to motors 26, 32, and 36 that drive condenser fan 24, evaporator fan 30, and compressor 18, respectively. The control circuitry uses information received from input device 40 and sensor 42 to determine when to operate motors 26, 32, and 36 that drive the air conditioning system. In some applications, the input device may be a conventional thermostat. However, the input device is not limited to thermostats, and more generally, any source of a fixed or changing set point may be employed. These may include local or remote command devices, computer systems and processors, mechanical, electrical and electromechanical devices that manually or automatically set a temperature-related signal that the system receives. For example, in a residential air conditioning system, the input device may be a programmable 24-volt thermostat that provides a temperature set point to the control circuitry. Sensor 42 determines the ambient air temperature and provides the temperature to control circuitry 38. Control circuitry 38 then compares the temperature received from the sensor to the temperature set point received from the input device. If the temperature is higher than the set point, control circuitry 38 may turn on motors 26, 32, and 36 to run air conditioning system 10. Additionally, the control circuitry may execute hardware or software control algorithms to regulate the air conditioning system. In some embodiments, the control circuitry may include an analog to digital (A/D) converter, a microprocessor, a non-volatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
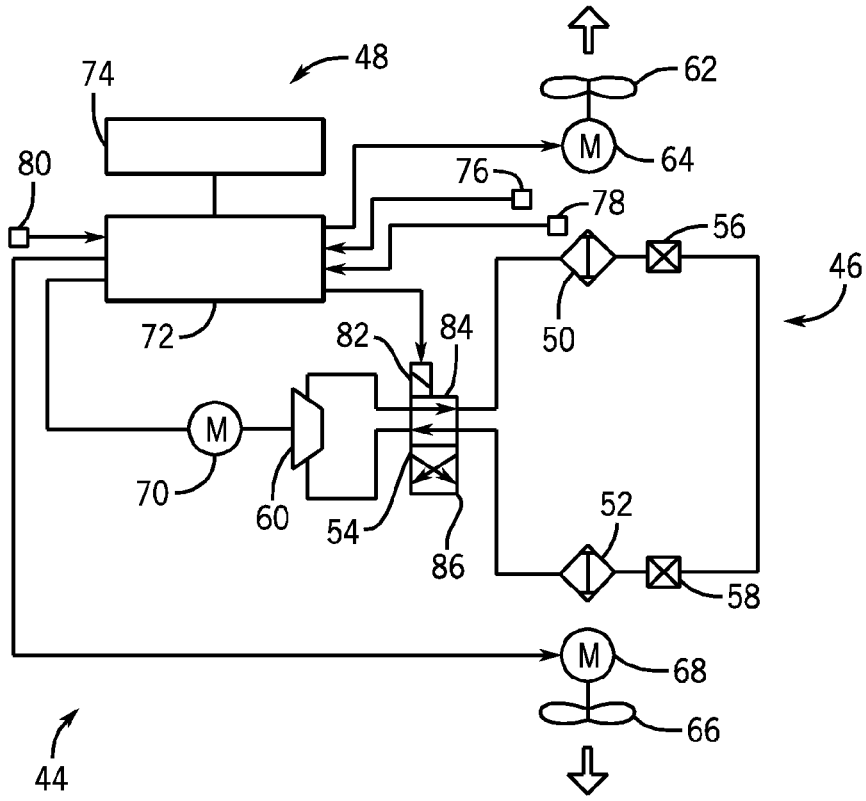
FIG. 5 is a diagrammatical overview of an exemplary heat pump system, which may employ one or more heat exchangers with manifold configurations.

FIG. 5 illustrates a heat pump system 44 that uses multichannel tubes. Because the heat pump may be used for both heating and cooling, refrigerant flows through a reversible refrigeration/heating loop 46. The refrigerant may be any fluid that absorbs and extracts heat. The heating and cooling operations are regulated by control devices 48.

Heat pump system 44 includes an outside coil 50 and an inside coil 52 that both operate as heat exchangers. The coils may function either as an evaporator or a condenser depending on the heat pump operation mode. For example, when heat pump system 44 is operating in cooling (or "AC") mode, outside coil 50 functions as a condenser, releasing heat to the outside air, while inside coil 52 functions as an evaporator, absorbing heat from the inside air. When heat pump system 44 is operating in heating mode, outside coil 50 functions as an evaporator, absorbing heat from the outside air, while inside coil 52 functions as a condenser, releasing heat to the inside air. A reversing valve 54 is positioned on reversible loop 46 between the coils to control the direction of refrigerant flow and thereby to switch the heat pump between heating mode and cooling mode.

Heat pump system 44 also includes two metering devices 56 and 58 for decreasing the pressure and temperature of the refrigerant before it enters the evaporator. The metering device also acts to regulate refrigerant flow into the evaporator so that the amount of refrigerant entering the evaporator equals the amount of refrigerant exiting the evaporator. The metering device used depends on the heat pump operation mode. For example, when heat pump system 44 is operating in cooling mode, refrigerant bypasses metering device 56 and flows through metering device 58 before entering the inside coil 52, which acts as an evaporator. In another example, when heat pump system 44 is operating in heating mode, refrigerant bypasses metering device 58 and flows through metering device 56 before entering outside coil 50, which acts as an evaporator. In other embodiments, a single metering device may be used for both heating mode and cooling mode. The metering devices typically are thermal expansion valves (TXV), but also may be orifices or capillary tubes.

The refrigerant enters the evaporator, which is outside coil 50 in heating mode and inside coil 52 in cooling mode, as a low temperature and pressure liquid. Some vapor refrigerant also may be present as a result of the expansion process that occurs in metering device 56 or 58. The refrigerant flows through multichannel tubes in the evaporator and absorbs heat from the air changing the refrigerant into a vapor. In cooling mode, the indoor air passing over the multichannel tubes also may be dehumidified. The moisture from the air may condense on the outer surface of the multichannel tubes and consequently be removed from the air.

After exiting the evaporator, the refrigerant passes through reversing valve 54 and into compressor 60. Compressor 60 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From the compressor, the increased temperature and pressure vapor refrigerant flows into a condenser, the location of which is determined by the heat pump mode. In cooling mode, the refrigerant flows into outside coil 50 (acting as a condenser). A fan 62, which is powered by a motor 64, draws air over the multichannel tubes containing refrigerant vapor. In some embodiments, the fan may be replaced by a pump that draws fluid across the multichannel tubes. The heat from the refrigerant is transferred to the outside air causing the refrigerant to condense into a liquid. In heating mode, the refrigerant flows into inside coil 52 (acting as a condenser). A fan 66, which is powered by a motor 68, draws air over the multichannel tubes containing refrigerant vapor. The heat from the refrigerant is transferred to the inside air causing the refrigerant to condense into a liquid.

After exiting the condenser, the refrigerant flows through the metering device (56 in heating mode and 58 in cooling mode) and returns to the evaporator (outside coil 50 in heating mode and inside coil 52 in cooling mode) where the process begins again.

In both heating and cooling modes, a motor 70 drives compressor 60 and circulates refrigerant through reversible refrigeration/heating loop 46. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 70 is controlled by control circuitry 72. Control circuitry 72 receives information from an input device 74 and sensors 76, 78, and 80 and uses the information to control the operation of heat pump system 44 in both cooling mode and heating mode. For example, in cooling mode, input device 74 provides a temperature set point to control circuitry 72. Sensor 80 measures the ambient indoor air temperature and provides it to control circuitry 72. Control circuitry 72 then compares the air temperature to the temperature set point and engages compressor motor 70 and fan motors 64 and 68 to run the cooling system if the air temperature is above the temperature set point. In heating mode, control circuitry 72 compares the air temperature from sensor 80 to the temperature set point from input device 74 and engages motors 64, 68, and 70 to run the heating system if the air temperature is below the temperature set point.

Control circuitry 72 also uses information received from input device 74 to switch heat pump system 44 between heating mode and cooling mode. For example, if input device 74 is set to cooling mode, control circuitry 72 will send a signal to a solenoid 82 to place reversing valve 54 in air conditioning position 84. Consequently, the refrigerant will flow through reversible loop 46 as follows: the refrigerant exits compressor 60, is condensed in outside coil 50, is expanded by metering device 58, and is evaporated by inside coil 52. If the input device is set to heating mode, control circuitry 72 will send a signal to solenoid 82 to place reversing valve 54 in heat pump position 86. Consequently, the refrigerant will flow through the reversible loop 46 as follows: the refrigerant exits compressor 60, is condensed in inside coil 52, is expanded by metering device 56, and is evaporated by outside coil 50.

The control circuitry may execute hardware or software control algorithms to regulate the heat pump system 44. In some embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 50 may condense and freeze on the coil. Sensor 76 measures the outside air temperature, and sensor 78 measures the temperature of outside coil 50. These sensors provide the temperature information to the control circuitry which determines when to initiate a defrost cycle. For example, if either of sensors 76 or 78 provides a temperature below freezing to the control circuitry, system 44 may be placed in defrost mode. In defrost mode, solenoid 82 is actuated to place reversing valve 54 in air conditioning position 84, and motor 64 is shut off to discontinue air flow over the multichannels. System 44 then operates in cooling mode until the increased temperature and pressure refrigerant flowing through outside coil 50 defrosts the coil. Once sensor 78 detects that coil 50 is defrosted, control circuitry 72 returns the reversing valve 54 to heat pump position 86. As will be appreciated by those skilled in the art, the defrost cycle can be set to occur at many different time and temperature combinations.

FIG. 6 is a perspective view of an exemplary heat exchanger that may be used in an air conditioning system 10 or a heat pump system 44. The exemplary heat exchanger may be a condenser 16, an evaporator 22, an outside coil 50, or an inside coil 52, as shown in FIGS. 4 and 5. It should also be noted that in similar or other systems, the heat exchanger may be used as part of a chiller or in any other heat exchanging application. The heat exchanger includes a bottom manifold 88 and a top manifold 90 that are connected by multichannel tubes 92. Although 30 tubes are shown in FIG. 6, the number of tubes may vary. The manifolds and tubes may be constructed of aluminum or any other material that promotes good heat transfer. Refrigerant flows from bottom manifold 88 through first tubes 94 to top manifold 90. The refrigerant then returns to bottom manifold 88 through second tubes 96. In some embodiments, the heat exchanger may be rotated approximately 90 degrees so that the multichannel tubes run horizontally between side manifolds. The heat exchanger may be inclined at an angle relative to the vertical. Furthermore, although the multichannel tubes are depicted as having an oblong shape, the tubes may be any shape, such as tubes with a cross-section in the form of a rectangle, square, circle, oval, ellipse, triangle, trapezoid, or parallelogram. In some embodiments, the tubes may have a diameter ranging from 0.5 mm to 3 mm. It should also be noted that the heat exchanger may be provided in a single plane or slab, or may include bends, corners, contours, and so forth.

Refrigerant enters the heat exchanger through an inlet 98 and exits the heat exchanger through an outlet 100. Although FIG. 6 depicts the inlet and outlet as located on bottom manifold 88, the inlet and outlet may be located on the top manifold in other embodiments. The fluid also may enter and exit the manifold from multiple inlets and outlets positioned on bottom, side, or top surfaces of the manifold. Baffles 102 separate the inlet 98 and outlet 100 portions of manifold 88. Although a double baffle 102 is illustrated, any number of one or more baffles may be employed to create separation of the inlet and outlet portions of the manifold.

Fins 104 are located between multichannel tubes 92 to promote the transfer of heat between tubes 92 and the environment. In one embodiment, the fins are constructed of aluminum, brazed or otherwise joined to the tubes, and disposed generally perpendicular to the flow of refrigerant. However, in other embodiments the fins may be made of other materials that facilitate heat transfer and may extend parallel or at varying angles with respect to the flow of the refrigerant. Further, the fins may be louvered fins, corrugated fins, or any other suitable type of fin.

Refrigerant exits the expansion device as a low pressure and temperature liquid and enters the evaporator. As the liquid travels through first multichannel tubes 94, the liquid absorbs heat from the outside environment causing the liquid to warm from its subcooled temperature (i.e., a number of degrees below the boiling point). Then, as the liquid refrigerant travels through second multichannel tubes 96, the liquid absorbs more heat from the outside environment causing it to boil into a vapor. Although evaporator applications typically use liquid refrigerant to absorb heat, some vapor may be present along with the liquid due to the expansion process. The amount of vapor may vary based on the type of refrigerant used. In some embodiments the refrigerant may contain approximately 15% vapor by weight and 90% vapor by volume. This vapor has a lower density than the liquid, causing the vapor to separate from the liquid within manifold 88. Consequently, certain flow channels of tubes 92 may contain only vapor.

FIG. 7 shows a perspective view of an internal configuration for the bottom manifold shown in FIG. 6. Manifold 88 contains a helical tape 106. The tape may be made of metal or any other material suitable for directing the flow of fluid. In some embodiments, the tape may be loose within the manifold while in other embodiments the tape may be fixed to the manifold by a method such as brazing. Alternatively, or in addition, the tape may be located on supports, grooves, or notches located within the manifold. Tape 106 is radially twisted to form barriers within manifold 88. Although two twists are shown in FIG. 6, the number and spacing of the twists may vary. Twists 108 create fluid flow in a radial pattern as generally indicated by arrows 110. The radial flow pattern promotes mixing of the refrigerant phases, creating a more homogenous mixture, which may enter flow channels 112. Additionally, tape 106 acts as a barrier to prevent the liquid phase refrigerant from flowing rapidly to the end of the manifold to collect near the baffles. The size of the tape relative to the manifold may vary based on the individual properties of a heat exchanger.

Figure 8:
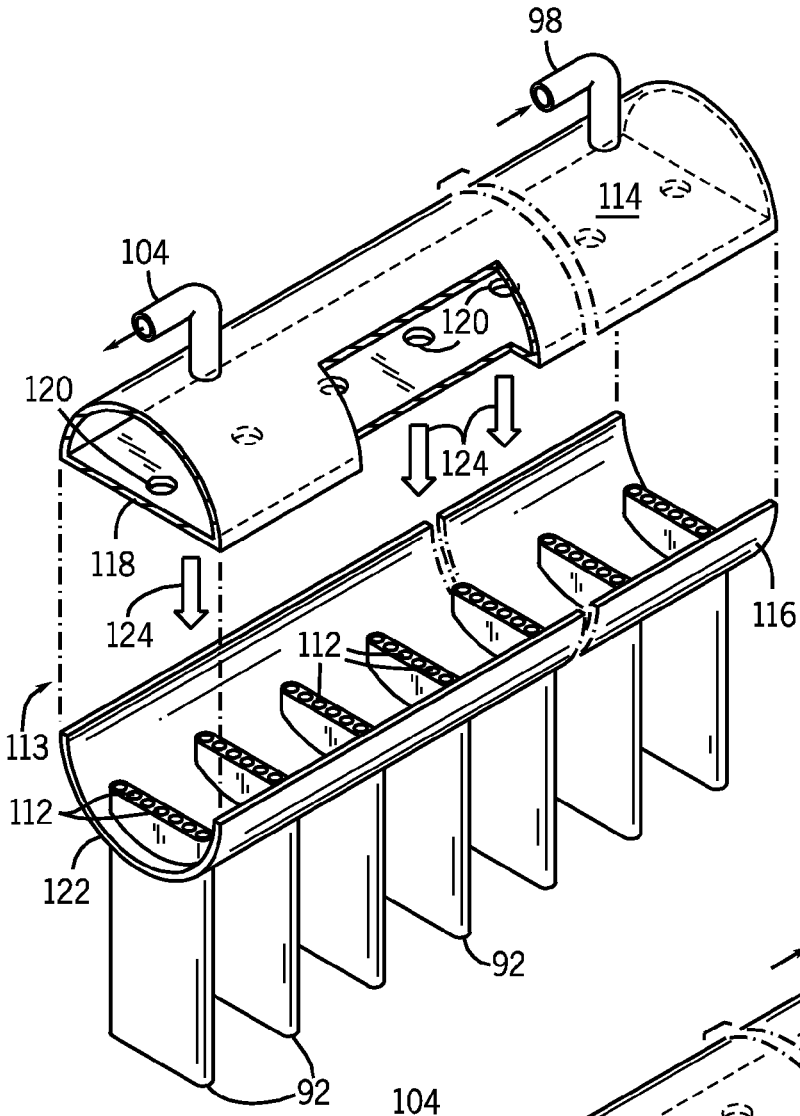
FIG. 8 is a detail perspective view of an exemplary manifold containing a partition with apertures.

FIG. 8 depicts an alternate manifold 113 that may be used to promote a homogenous mixture of refrigerant entering the flow channels. It should be noted that the manifold shown in FIG. 8, as well as subsequent manifolds, is illustrated in a top position to show that the manifold configuration could be employed in a top manifold, in addition to a bottom or side manifold. Alternate manifold 113 includes a top section 114 and a bottom section 116 that when attached form the manifold. The sections may be attached by any suitable method such as welding or brazing. Top section 114 includes a partition 118 disposed along the bottom surface. The partition may be an integrated part of the top section created during the forming process, or it may be a separate component attached to the top section after forming. If the partition is a separate component, it may be attached by any suitable method including, but not limited to welding or brazing. Partition 118 contains apertures 120 that allow fluid transfer between the top and bottom sections. The apertures may include varying diameters and spacing depending on the individual properties of the heat exchanger. Bottom section 116 includes a curvature 122 that forms a semi-circle. The curvature promotes collection of fluid in the bottom of the manifold.

Refrigerant enters the manifold through an inlet 98 and travels through top section 114. As the refrigerant flows through top section 114, some of the refrigerant passes through apertures 120 to bottom section 116. The direction of fluid flow 124 is primarily from the top section to the bottom section. Typically, liquid will flow to the bottom section while the vapor phase refrigerant remains in the top section. In some applications, however, vapor phase that has flowed into the bottom section may return to the top section through the apertures. The liquid refrigerant collects in curvature 122, and as the liquid rises, it spills over to enter flow channels 112. Consequently, the vapor phase refrigerant entering the flow channels from above is mixed with the liquid phase refrigerant spilling into the flow channels. Additionally, top section 118 promotes separation of the vapor phase refrigerant from the flow channels, resulting in a higher ratio of liquid phase refrigerant entering the flow channels. In some embodiments, the vapor phase refrigerant that remains in the top section may be directed out of top section 114 through a vent 104. The vent may be connected to a return line for the compressor or it may be discharged outside of the refrigeration system.

Figure 9:
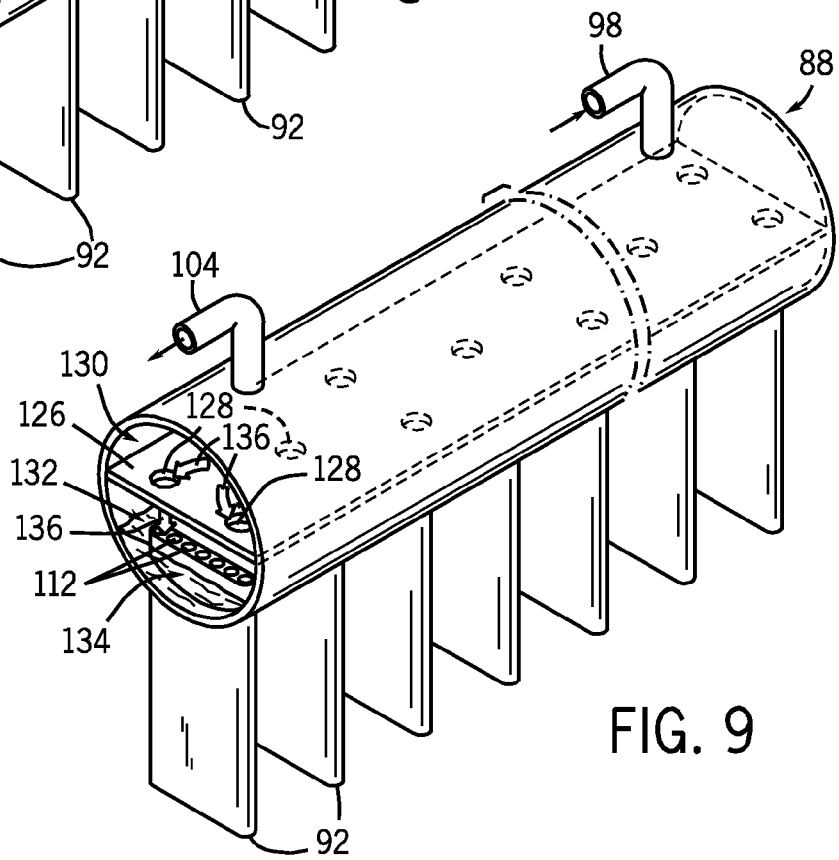
FIG. 9 is a detail perspective view of another exemplary manifold containing a plate style partition with apertures.

FIG. 9 depicts an alternate internal configuration for manifold 88. Manifold 88 includes an interior partition 126 that contains apertures 128. The apertures may be placed at varying distances and locations along the partition and may vary in size and/or shape. Partition 126 divides the manifold into an upper section 130 and a lower section 132. The partition may be constructed of any material sufficient to direct fluid flow. Additionally, the partition may be attached to the manifold by a method such as welding or brazing, the partition may be inserted loosely into the manifold, or the partition may be partially connected to the manifold by grooves, brackets, or similar structures contained in the manifold.

Refrigerant enters the manifold through inlet 98. As the refrigerant contacts partition 126, the liquid phase refrigerant flows through apertures 128 into lower section 132. The liquid phase refrigerant collects in lower section 132 and spills over into flow channels 112. The vapor phase refrigerant rises in manifold 88 and may be collected in upper section 130. In some embodiments, the vapor refrigerant may exit the manifold through an optional vent 104 and be returned to the compressor or discharged from the system. The direction of fluid flow 136 is primarily from upper section 130 into lower section 132, however, some vapor may return to upper section 130 through openings 128. The separation of the vapor phase within upper section 130 increases the ratio of liquid phase refrigerant entering the flow channels. Additionally, the vapor phase refrigerant that enters flow channels 112 from above is mixed with the liquid phase refrigerant spilling into flow channels 112.

Figure 10:
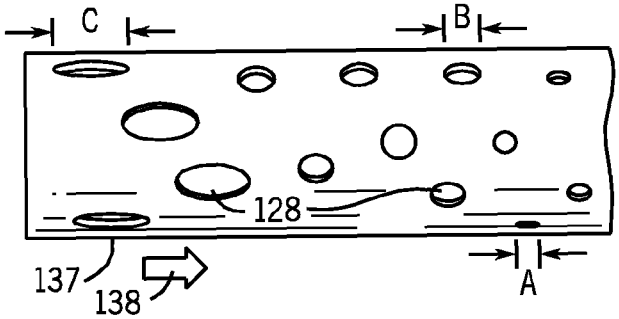
FIG. 10 is a detail top elevational view of an alternate partition for use in the manifold shown in FIG. 9.

FIG. 10 depicts an alternate partition 137 that may be used in the manifold shown in FIG. 9. The direction of fluid flow is generally indicated by an arrow 138. Apertures 128 may be of different diameters A, B, C. In the illustrated embodiment, the diameters decrease with the direction of fluid flow. For instance, the apertures farther away from the fluid inlet have a small diameter A while the apertures closer to the inlet have a larger diameter C. Typically, the fluid enters the manifold at a velocity that causes the fluid to flow toward the far end of the manifold. The small diameter apertures direct the fluid back towards the inlet, preventing the fluid from collecting at the far end of the manifold. In other embodiments, the diameter of the apertures may increase with the direction of fluid flow, or the diameter may vary in a random or patterned configuration throughout the baffle. The partition also may include apertures of various shapes such as circles, squares, or ovals.

Figure 11:
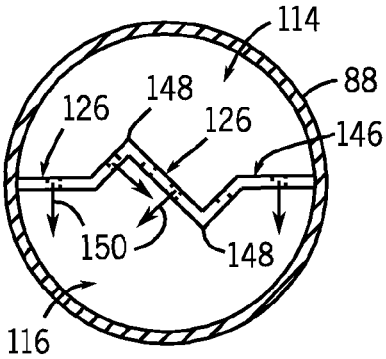
FIG. 11 is a front sectional view of the exemplary manifold shown in FIG. 9 sectioned through the manifold tube illustrating another alternate partition.

FIG. 11 is a front sectional view of another alternate partition 146 that contains longitudinal bends 148. Bends 148 may provide mechanical support and may create flexibility in the partition shape. For example, the bends may be increased in certain areas of the manifold, to allow the baffle to fit within curved sections of the manifold. Arrows 150 generally indicate the direction of fluid flow. Fluid flows from top section 114 through the apertures 126 into the bottom section 116. The bends may be disposed at any angle, and any number of bends may be included in the partition. Furthermore, the partition may be formed from a flexible material so that the baffle can be contracted within the manifold to fit within curved sections. In other embodiments, the partition may be formed from a rigid material that is tailored to the shape of the manifold. Bends in the partition also allow the tubes of the heat exchanger to be bent or formed after assembly while preventing or reducing linking of the partition during such operations.

Figure 12:
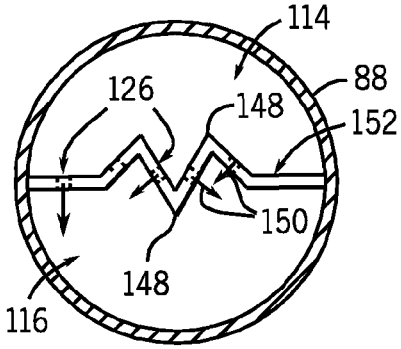
FIG. 12 is a front sectional view of the exemplary manifold shown in FIG. 9 sectioned through the manifold tube illustrating yet another alternate plate.

FIG. 12 is a front sectional view of another partition 152. Partition 152 contains several longitudinal bends 148 that allow the baffle to be expanded or contracted as necessary to fit the shape of the manifold. The partition may be fixed within the manifold by methods such as brazing or welding, the partition may be partially connected to the manifold by grooves or brackets, or the partition may not be attached to the manifold.

Figure 13:
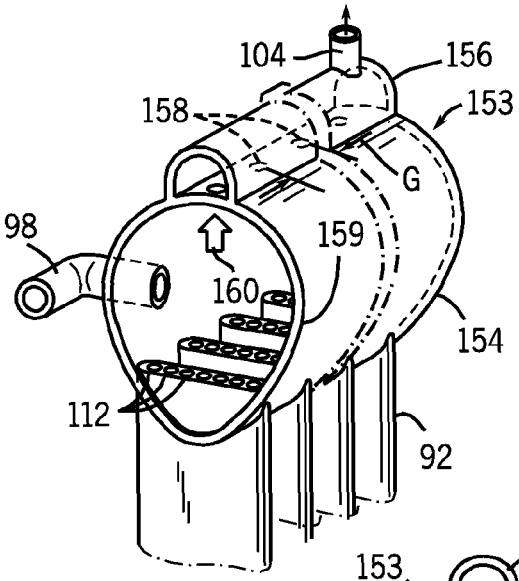
FIG. 13 is a detail perspective view of an exemplary manifold containing an upper section and a lower section.

FIG. 13 illustrates an alternate manifold 153 that may be used in the heat exchanger shown in FIG. 6. Manifold 153 includes a bottom section 154 and a top section 156 which may be affixed together by brazing or other joining methods to form the manifold. Alternatively, the top section may be formed as an integral piece during formation of the manifold. Fluid enters manifold 153 through inlet 98, which is disposed within bottom section 154. Bottom section 154 has a teardrop shaped cross-section 159 that promotes collection of liquid phase refrigerant in bottom section 154 and collection of vapor phase refrigerant in top section 156. Apertures 158 within top section 156 allow fluid to flow between sections 154 and 156. Typically, the vapor phase refrigerant will flow upward through apertures 158 into top section 156, as indicated generally by reference numeral 160 while the liquid phase refrigerant will collect in bottom section 154. Consequently, refrigerant existing primarily in a liquid phase will enter tubes 92. The vapor contained in top section 156 may be released from manifold 153 by optional vent 104. The vent may discharge the vapor from the system or return the vapor to the compressor. A distance G that separates apertures 158 may be uniform or varying throughout the top section. Additionally, the apertures may be uniform or varying shapes with cross-sections in the shape of a circle, rectangle, or cross.

Figure 14:
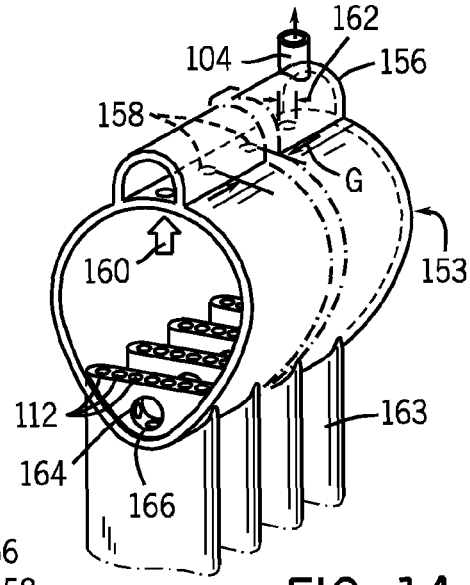
FIG. 14 is a detail perspective view of an alternate embodiment of the manifold shown in FIG. 13 illustrating multichannel tubes containing openings.

FIG. 14 illustrates alternate tubes 163 that may be used with the manifold shown in FIG. 13. The tubes contain openings 164 that allow fluid to pass through the tubes. As the fluid flows through tube openings 164, it may enter lower flow channels 166 contained within the openings. The lower flow channels may be a continuation of existing flow channels 112. Alternatively, the lower flow channels may be independent flow channels. Tube openings 164 allow fluid that has collected in the bottom of the manifold to enter tubes 163. The fluid that collects in the bottom of the manifold will primarily be liquid phase refrigerant. Therefore, the fluid entering lower flow channels 166 will primarily be liquid phase refrigerant, ensuring that each tube contains at least some flow channels containing primarily liquid phase refrigerant. Furthermore, the vapor refrigerant that enters flow channels 112 from above, may flow into tube openings 164 and mix with the liquid phase refrigerant.

Figure 15:
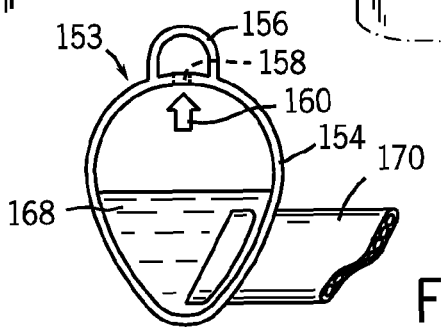
FIG. 15 is a front sectional view of an alternate embodiment of the manifold shown in FIG. 13 illustrating multichannel tubes entering the side of the manifold.

FIG. 15 is a front sectional view of manifold 153 showing an alternate tube configuration. Liquid 168 collects in the bottom of the manifold. The vapor, which has a lower density, rises to the top of the manifold and flows through openings 150 into top section 156. Tubes 170 are disposed perpendicular to the manifold so openings to flow channels 112 are located within liquid section 168. This ensures primarily liquid phase refrigerant enters tubes 170. The tubes 170 have an angled end 172 that follows the contour of the manifold.

Figure 16:
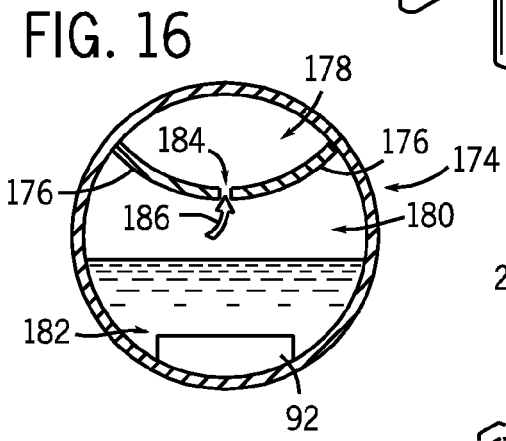
FIG. 16 is a front sectional view of an exemplary manifold sectioned through the manifold tube illustrating an alternate top section for the manifold shown in FIG. 13.

FIG. 16 is a front view of an alternate manifold 174. Dividers 176 separate manifold 174 into an upper section 178 and a lower section 180. After the fluid enters lower section 180, liquid phase 182 collects within lower section 180 while the vapor phases rises. A channel 184 between dividers 176 allows the vapor to flow upward into upper section 178, as indicated generally by reference number 186. The dividers may be formed when the manifold is created using a method such as extrusion. In other embodiments, the dividers may be inserted into the manifold after formation and brazed or fixed to the manifold by other means. The dividers may be formed from any material suitable to direct fluid flow.

Figure 17:
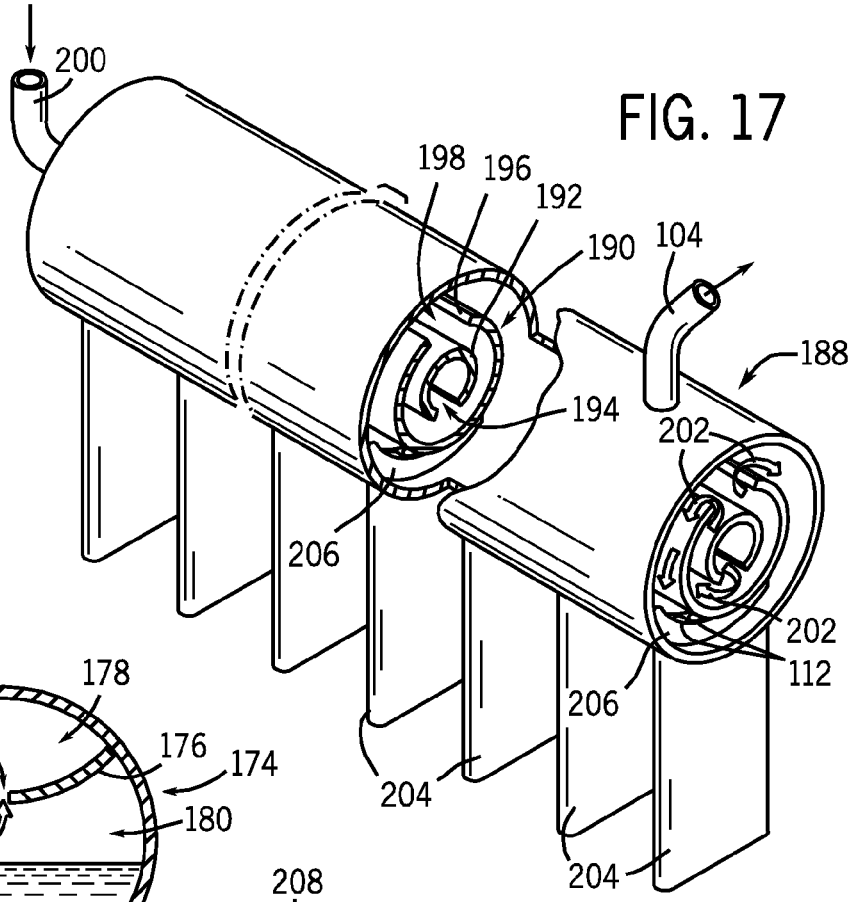
FIG. 17 is a detail perspective view of an exemplary manifold containing curved partitions.

FIG. 17 illustrates another manifold 188 that may be employed with the heat exchanger shown in FIG. 6. Manifold 188 contains curved partitions 190 that direct fluid flow within the manifold. The partitions may be created during formation of the manifold, or the partitions may be inserted into the manifold after formation and affixed using brazing, welding, or other attachment methods. An inner partition 192 includes a bottom opening 194, and an outer partition 196 includes a top opening 198. Fluid enters the manifold through an inlet 200 disposed on the end of the manifold. Inlet 200 is aligned with inner partition 192 causing the fluid to flow into the inner partition. Fluid exits inner partition 192 through bottom opening 194. From the bottom opening, the fluid is directed upward by outer partition 196. Arrows 202 generally indicate the direction of the fluid flow. The partitions promote separation of the fluid phases by causing the vapor fluid to rise to the top of the manifold while the liquid phase fluid collects in the bottom of the manifold. This allows the vapor phase refrigerant entering flow channels 112 to be mixed with the liquid phase refrigerant. Additionally, tubes 204 are cut to follow the manifold curvature 206 promoting an even distribution of liquid phase refrigerant in each flow channel of an individual tube.

Figure 18:
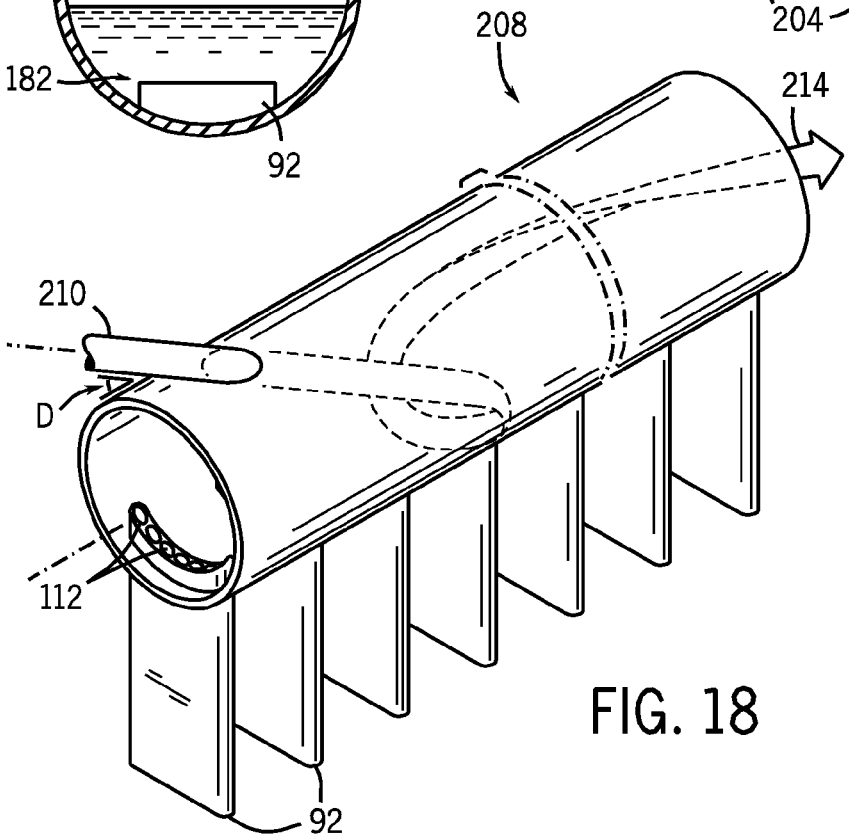
FIG. 18 is a detail perspective view of an exemplary manifold containing an angled inlet.

FIG. 18 shows another manifold 216 which may be used in the heat exchanger shown in FIG. 6. Inlet 210 is disposed at an angle D relative to the manifold. The angle is typically a compound angle occurring in all three directions. The angle in each direction may be varied to achieve different flow patterns. In this embodiment, angled inlet 210 causes the fluid within the manifold to flow in a spiral pattern as indicated generally by reference numeral 214. The spiral flow pattern causes both the liquid and vapor phase refrigerant to travel down the length of the manifold, promoting a more homogenous distribution of refrigerant within each tube 92.

Figure 19:
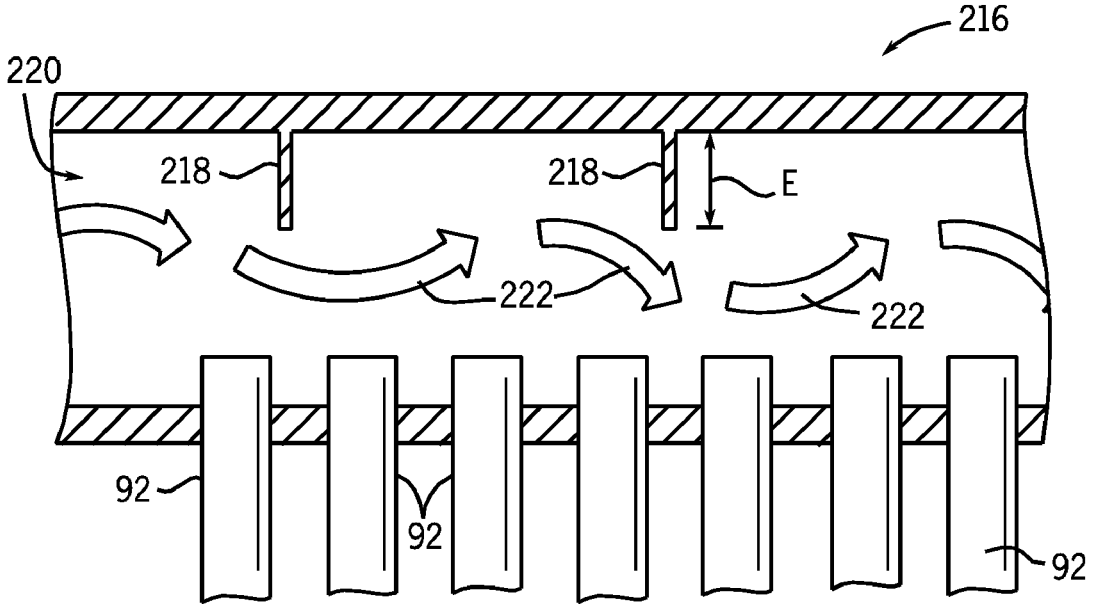
FIG. 19 is a cross-sectional view of an exemplary manifold sectioned lengthwise through the manifold illustrating interior baffles.

FIG. 19 shows a lengthwise cross-section of yet another alternate manifold 216. Manifold 216 contains baffles 218 which extend from the top of the manifold into the interior volume 220 to direct fluid flow 222. Baffles 218 have a height E which extends partially into the manifold causing fluid flow in alternating vertical directions as generally indicated by arrows 222. The number of baffles within a manifold, as well as the spacing between them, may vary. Although the baffles shown in FIG. 19 have a uniform height, in other embodiments, the height of the baffles may vary throughout the manifold. The baffles may be created when the manifold is formed or inserted into the manifold after formation.

Figure 20:
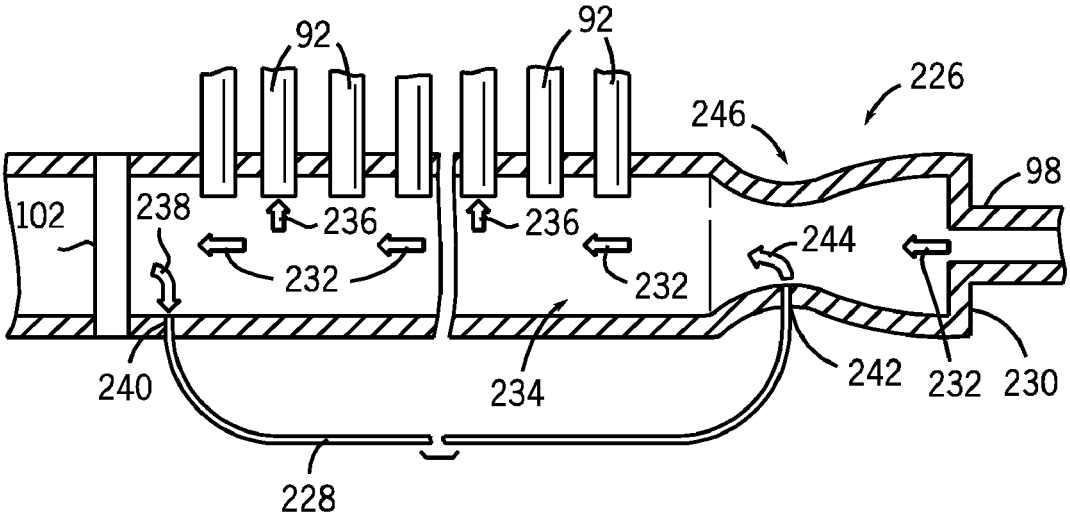
FIG. 20 is a cross-sectional view of an exemplary manifold sectioned lengthwise through the manifold illustrating a liquid return line and a venturi.

FIG. 20 shows a lengthwise cross-section of still another alternate manifold 226 that contains a liquid return line 228. Fluid enters manifold 226 through an inlet 98 disposed on a manifold end 230. The fluid enters and flows horizontally through the manifold as indicated generally by an arrow 232. The fluid also may flow vertically as indicated by arrows 236 to enter tubes 92. If the fluid enters the manifold at a high enough velocity, the velocity may propel the liquid phase refrigerant toward baffle 102 at the far end of the manifold, causing the liquid to bypass tubes 92. After contacting the baffle, the liquid is directed downward 238 into the liquid return line inlet 240. The liquid flows through the liquid return line 228 and exits through return outlet 242. The liquid returns to the manifold as indicated by an arrow 244. Additionally, a venturi 246 is located near inlet 98. Venturi 246 constricts the fluid flow, reducing the pressure and causing some of the vapor refrigerant to condense into a liquid. Consequently, the venturi promotes a higher ratio of liquid phase refrigerant within the manifold. The venturi also creates suction needed to pull the liquid phase refrigerant through the liquid return line.

The manifold configurations described herein may find application in a variety of heat exchangers and HVAC&R systems containing heat exchangers. However, the configurations are particularly well-suited to evaporators used in residential air conditioning and heat pump systems and are intended to provide a more homogenous distribution of vapor phase and liquid phase refrigerant within heat exchanger tubes.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum". However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features of the invention have been illustrated and described herein, many modifications and changes will occur to those skilled in the art. For example, the manifold configurations illustrated may be used in a variety of manifold locations such as top manifolds, bottom manifolds, or side manifolds. It is, therefore, to be understood that the appended claims are intended to cover all such modifications and changes as fall within the true spirit of the invention. Furthermore, in an effort to provide a concise description of the exemplary embodiments, all features of an actual implementation may not have been described. It should be appreciated that in the development of any such actual implementation, as in any engineering or design project, numerous implementation specific decisions must be made. Such a development effort might be complex and time consuming, but would nevertheless be a routine undertaking of design, fabrication, and manufacture for those of ordinary skill having the benefit of this disclosure.

The invention claimed is:

1. A heat exchanger comprising:

a first manifold configured to receive a mixed phase flow of liquid and vapor;

a second manifold;

a plurality of multichannel tubes in fluid communication with the first and second manifolds; and a flow mixer disposed in the first manifold and configured to promote mixing of the liquid and vapor to direct mixed phase flow through the multichannel tubes.

2. The heat exchanger of claim 1, wherein the flow mixer includes a diverter element arranged to direct mixed phase flow towards flow path entrances of the multichannel tubes.

3. The heat exchanger of claim 2, wherein the diverter element is a generally helical member.

4. The heat exchanger of claim 1, wherein the flow mixer includes a partition in which apertures are formed to communicate mixed phase flow from an entrance portion of the first manifold to an exit portion with which the multichannel tubes are in fluid communication.

5. The heat exchanger of claim 4, wherein the apertures are of different sizes along a length of the partition.

6. The heat exchanger of claim 5, wherein the sizes of the apertures decrease from an entrance end of the first manifold towards a distal end.

7. The heat exchanger of claim 4, wherein the partition is non-planar.

8. The heat exchanger of claim 7, wherein the partition includes longitudinal bends.

9. A heat exchanger comprising:

a first manifold configured to receive a mixed phase flow of liquid and vapor;

a second manifold; and a plurality of multichannel tubes in fluid communication with the first and second manifolds;

wherein the first manifold is configured to promote mixing of the liquid and vapor to direct mixed phase flow through the multichannel tubes;

wherein the first manifold includes a flow mixer configured to promote mixing of the liquid and vapor to direct mixed phase flow through the multichannel tubes; and wherein the flow mixer includes a partition in which apertures are formed to communicate mixed phase flow from an entrance portion of the first manifold to an exit portion with which the multichannel tubes are in fluid communication.

10. The heat exchanger of claim 9, wherein the apertures are of different sizes along a length of the partition.

11. The heat exchanger of claim 10, wherein the sizes of the apertures decrease from an entrance end of the first manifold towards a distal end.

12. The heat exchanger of claim 9, wherein the partition is non-planar.

13. The heat exchanger of claim 12, wherein the partition includes longitudinal bends.

14. A heating, ventilating, air conditioning or refrigeration system comprising:

a compressor configured to compress a gaseous refrigerant;

a condenser configured to receive and to condense the compressed refrigerant;

an expansion device configured to reduce pressure of the condensed refrigerant; and an evaporator configured to evaporate the refrigerant prior to returning the refrigerant to the compressor, the evaporator including a first manifold configured to receive a mixed phase refrigerant flow, a second manifold, and a plurality of multichannel tubes in fluid communication with the first and second manifolds, wherein the first manifold is configured to promote mixing of the liquid and vapor to direct mixed phase flow through the multichannel tubes;

wherein the first manifold includes a flow mixer configured to promote mixing of the liquid and vapor to direct mixed phase flow through the multichannel tubes; and wherein the flow mixer includes a partition in which apertures are formed to communicate mixed phase flow from an entrance portion of the first manifold to an exit portion with which the multichannel tubes are in fluid communication.

15. The system of claim 14, wherein the apertures are of different sizes along a length of the partition.

16. The system of claim 15, wherein the sizes of the apertures decrease from an entrance end of the first manifold towards a distal end.

17. A heat exchanger comprising:

a first manifold configured to receive a mixed phase flow of liquid and vapor;

a second manifold; and a plurality of multichannel tubes in fluid communication with the first and second manifolds;

wherein the first manifold is configured to promote mixing of the liquid and vapor to direct mixed phase flow through the multichannel tubes;

wherein the first manifold includes a flow mixer configured to promote mixing of the liquid and vapor to direct mixed phase flow through the multichannel tubes; and wherein the flow mixer includes a diverter element arranged to direct mixed phase flow towards flow path entrances of the multichannel tubes.

18. The heat exchanger of claim 17, wherein the diverter element is a generally helical member.

19. A heat exchanger comprising:

a first manifold configured to receive a mixed phase flow of liquid and vapor;

a second manifold; and a plurality of multichannel tubes in fluid communication with the first and second manifolds;

wherein the first manifold is configured to promote mixing of the liquid and vapor to direct mixed phase flow through the multichannel tubes; and wherein the first manifold has an inlet configured to inject mixed phase flow into the first manifold at an angle that causes swirling of the mixed phase flow within the first manifold.

20. A heating, ventilating, air conditioning or refrigeration system comprising:

a compressor configured to compress a gaseous refrigerant;

a condenser configured to receive and to condense the compressed refrigerant;

an expansion device configured to reduce pressure of the condensed refrigerant; and an evaporator configured to evaporate the refrigerant prior to returning the refrigerant to the compressor, the evaporator including a first manifold configured to receive a mixed phase refrigerant flow, a second manifold, and a plurality of multichannel tubes in fluid communication with the first and second manifolds, wherein the first manifold is configured to promote mixing of the liquid and vapor to direct mixed phase flow through the multichannel tubes;

wherein the first manifold includes a flow mixer configured to promote mixing of the liquid and vapor to direct mixed phase flow through the multichannel tubes; and wherein the flow mixer includes a diverter element arranged to direct mixed phase flow towards flow path entrances of the multichannel tubes.

21. The system of claim 20, wherein the diverter element is a generally helical member.

* * * * *